US007169067B2

(12) United States Patent
Town

(10) Patent No.: US 7,169,067 B2
(45) Date of Patent: Jan. 30, 2007

(54) HAND TO EYE COORDINATION TRAINING AID

(76) Inventor: Gary Dale Town, 9705 NW. 29th Ave., Vancouver, WA (US) 98665

( * ) Notice: Subject to any disclaimer, the term of this patent is extended or adjusted under 35 U.S.C. 154(b) by 65 days.

(21) Appl. No.: 10/907,416

(22) Filed: Mar. 31, 2005

(65) Prior Publication Data

US 2006/0199671 A1 Sep. 7, 2006

Related U.S. Application Data

(63) Continuation-in-part of application No. 10/904,510, filed on Nov. 14, 2004.

(51) Int. Cl.
*A63B 69/00* (2006.01)
*A63B 71/00* (2006.01)

(52) U.S. Cl. ..... 473/417; 473/422

(58) Field of Classification Search ..... 473/417, 473/415, 453, 419, 220, 269, 422; 313/499
See application file for complete search history.

(56) References Cited

U.S. PATENT DOCUMENTS

| | | | | |
|---|---|---|---|---|
| 4,139,198 | A | 2/1979 | Kanavas | |
| 4,508,339 | A | 4/1985 | Llewellyn | |
| 4,819,937 | A | 4/1989 | Gordon | |
| 4,822,042 | A | 4/1989 | Landsman | |
| 4,834,375 | A * | 5/1989 | Elstein et al. | 473/417 |
| 5,031,909 | A | 7/1991 | Pecker | |
| 5,080,362 | A | 1/1992 | Lillard | |
| 5,100,134 | A * | 3/1992 | Becker | 473/417 |
| 5,380,001 | A | 1/1995 | Socci et al. | |
| 5,428,846 | A | 7/1995 | Socci et al. | |
| 5,447,305 | A | 9/1995 | Socci et al. | |
| 5,472,205 | A | 12/1995 | Bouton | |
| 5,538,250 | A | 7/1996 | Putz | |
| 5,692,965 | A | 12/1997 | Nighan, Jr. et al. | |
| 5,746,663 | A | 5/1998 | Calace | |
| 5,800,278 | A | 9/1998 | Varriano | |
| 5,976,037 | A | 11/1999 | Watson | |
| 6,146,289 | A | 11/2000 | Miller et al. | |
| 6,238,307 | B1 | 5/2001 | Owen | 473/417 |
| 2002/0183567 | A1 | 12/2002 | Socci et al. | |
| 2003/0036445 | A1 | 2/2003 | Udwin et al. | |
| 2003/0036446 | A1 | 2/2003 | Udwin et al. | 473/417 |
| 2003/0104874 | A1 | 6/2003 | Galanis et al. | 473/221 |
| 2005/0107180 | A1 * | 5/2005 | Halleck et al. | 473/220 |

FOREIGN PATENT DOCUMENTS

| | | | |
|---|---|---|---|
| WO | WO97/04839 | * | 2/1997 |

* cited by examiner

*Primary Examiner*—Eugene Kim
*Assistant Examiner*—M. Chambers
(74) *Attorney, Agent, or Firm*—Bruce E Harang

(57) ABSTRACT

A swing training device which utilizes an microprocessor controlled set of colored LEDs to teach the user to watch the ball through the contact of a ball hitting device such as a baseball bat or golf club with the ball. Also shown is a method of providing a confirmation visual for an observer to confirm the hitter has in fact watched the bat hit the ball. This swing training device may be mounted in a standard batting tee stanchion or may replace a standard batting tee stanchion. The swing training device may also be mounted in a practice golf tee especially those of the type used at driving ranges.

20 Claims, 12 Drawing Sheets

HAND TO EYE COORDINATION TRAINING AID

This is a Continuation-In-Part of co-pending U.S. application Ser. No. 10/904,510 filed Nov. 14, 2004.

BACKGROUND OF THE INVENTION

1. Field of the Invention

The present invention generally relates to a sports swing training apparatus. More specifically, the present invention relates to a training device that assists a user in attaining proper eye contact with a ball as it is struck by a piece of sports equipment.

2. Description of the Related Art

Baseball has been and continues to be a very popular sport in the United States and in many other countries. With the development of better medical understanding of the stresses imposed on players, a variation of the baseball game known as T-ball has become increasingly popular as a means of avoiding injury to young players' arms from throwing baseballs at too early an age. The game of T-ball avoids the necessity of having a skilled catcher and a skilled pitcher. In addition, it allows the batter to concentrate on learning successfully hit the ball and develop a proper swing. To this end, batting tees are well known in the art for use in instructing and improving a baseball player's batting ability. In addition, batting tees are a good training tool for older players at all levels to assist in improving, or correcting, a less than optimum batting swing. Most existing batting tees have a base member constructed in the shape of a home-plate, with a ball supporting post or "tee" extending up from the base member upon which a baseball or the like to be batted is supported. The tee usually has some type of telescopic construction which enables the height of the ball to be adjusted to simulate high and low pitches, as well as to compensate for different sized players or batters. One of the main issues with teaching or correcting a swing is teaching the batter not to move his head, and therefore his eye contact with the ball, before the ball is hit by the bat. While there have been a number of mechanical devices proposed for addressing this issue, none have provided a simple means to accomplish the goal of eye contact with the ball until after it is hit by the bat.

Likewise, golf is one of the most popular sports games in the United States as well as many other parts of the world. Like baseball, one of the most difficult and yet most important requirements of the game is to keep the players eye contact on the ball until the ball has been hit by the head of the golf club. While there have been a number of mechanical devices as well as electronic devises built into the golf club, none have provided a simple means to accomplish the goal of eye contact with the ball until after it is hit by the club.

For example, U.S. Pat. No. 4,139,198 issued Feb. 13, 1979 to Kanavas, teaches a training device a golfer can attach to his putter to assist in developing accuracy and consistency in his putting.

U.S. Pat. No. 4,508,339 issued Apr. 2, 1985 to Llewellyn, teaches a device for improving eye-hand coordination in hitting a ball using a tee with a spring loaded swing arm.

U.S. Pat. No. 4,819,937 issued Apr. 11, 1989 to Gordon, teaches a baseball practice device which may be used as a batting tee or a strike zone indicator having a pair of upright stanchions.

U.S. Pat. No. 4,822,042 issued Apr. 18, 1989 to Landsman, teaches an electronic device which senses when and where a ball hits a racquet on which the electronic device is mounted.

U.S. Pat. No. 5,031,909 issued Jul. 16, 1991 to Pecker, teaches mounting force sensors on the strings of a racquet in the hitting target area to generate an audible signal when the racquet impacts a ball. Different audible signals sound for different areas of the racquet head.

U.S. Pat. No. 5,080,362 issued Jan. 14, 1992 to Lillard, teaches an impact-sensing device that visually signals the impact of a ball by the sporting implement to which it is attached.

U.S. Pat. No. 5,380,001 issued Jan. 10, 1995 to Socci et al. teaches an electrical device for mounting in a batting helmet to audibly tell a batter wearing the batting helmet when his head is not correctly positioned in relationship to his shoulders during a swing.

U.S. Pat. No. 5,428,846 issued Jul. 4, 1995 to Socci et al. teaches another head position warning system for mounting in a batting helmet.

U.S. Pat. No. 5,447,305 issued Sep. 5, 1995 to Socci et al. teaches another variation of a batting helmet mounted head position warning system.

U.S. Pat. No. 5,472,205 issued Dec. 5, 1995 to Bouton teaches an electronic device which is connected to a personal computer and which can determine the club head angle of a golf club as it is used to hit a golf ball and report the information to the personal computer.

U.S. Pat. No. 5,538,250 issued Jul. 23, 1996 to Putz teaches a mechanical golf ball sighting device for mounting on a golfer's hat brim. The device encourages the golfer to keep his head still and his focus on the ball until the club impacts the ball.

U.S. Pat. No. 5,692,965 issued Dec. 2, 1997 to Nighan Jr. et al. teaches a laser device attachable to a golf club shaft to provide a visual aid during a golf swing which is indicative of the user's position.

U.S. Pat. No. 5,746,663 issued May 5, 1998 to Calace teaches a mechanical device to be attached to a user by means of a mouthpiece for clamping by the user's teeth and to the user's belt at his back to physically restrain the user's head movement during a golf swing.

U.S. Pat. No. 5,800,278 issued Sep. 1, 1998 to Varriano teaches an infrared device for mounting on a user's head to align his eyes with the ball during a swing.

U.S. Pat. No. 5,976,037 issued Nov. 21, 1999 to Watson teaches a mechanical device for maintaining the head position of a batter swinging at a ball by using a mouthpiece clamped in the batter's teeth connected to any attachment means attached to the batter's chest area.

U.S. Pat. No. 6,146,289 issued Nov. 14, 2000 to Miller et al. teaches a powered, moveable hitting or batting tee.

U.S. Pat. No. 6,238,307 issued May 29, 2001 to Owen teaches a manually moveable batting or hitting tee.

U.S. Patent Application Publication Number 2002/0183657 published Dec. 5, 2002 to Socci et al. teaches head gear to be worn by a hitter to electronically indicate the hitter's head motion or position.

U.S. Patent Application Publication Number 2003/0036446 published Feb. 20, 2003 to Udwin et al. teaches a baseball hitting kit comprising a ball, a bat, a hitting tee, and a storage container.

U.S. Patent Application Publication Number 2003/0104874 published Jun. 5, 2003 to Galanis et al. teaches a golf club head using an electronic infrared sensing system to determine and report the club head angle during a golf swing.

U.S. Patent Application Publication Number 2004/0014531 published Jan. 22, 2004 to Ziener-Gundersen teaches a device containing at least one microprocessor mountable upon a golf club using a LED or LCD display to show the swing of a club.

U.S. Patent Application Publication Number 2004/0106092 published Jun. 3, 2004 to Galanis et al. teaches an electronic infrared sensing system mounting in a golf club head to determine and report the club head angle during a golf swing.

There remains a need for a simple, easy to use device for training hitters to develop good eye-hand coordination and to keep eye contact with the ball through impact with the ball by a hitting device, such as a bat, club, or racquet, without the need for mounting such a device on the hitter or on the hitting device.

DISCLOSURE OF THE INVENTION

The present invention provides advantages and alternatives over the prior art by providing an eye to hand coordination training aid which is easy to use, adaptable to different types of ball impacting games, is rugged, and inexpensive.

According to a further aspect of the present invention, there is provided a sports training apparatus teaching eye-hand coordination for impacting an object comprising: a swing training aid comprising a substantially cylindrical body and a ball holder positioned on one end of said substantially cylindrical body; a ball detecting apparatus in said swing training aid operable in a configuration for determining the presence or absence of a ball on said ball holder; and three colored indicator lights operable in a configuration to display a single color for a desired amount of time after the ball is impacted off of said ball holder, then turning off for a desired amount of time and finally displaying the same single color for a second desired amount of time; thereby allowing the user to determine if he focused on the ball until after impacting the ball.

According to yet another aspect of the present invention there is presented a sports training apparatus teaching eye-hand coordination for impacting an object comprising: a swing training aid comprising a substantially cylindrical body and a ball holder positioned on one end of said substantially cylindrical body; a ball detecting apparatus in said swing training aid operable in a configuration for determining the presence or absence of a ball on said ball holder; three colored indicator lights operable in a configuration to display a single color for a desired amount of time after the ball is impacted off of said ball holder, then turning off for a desired amount of time and finally displaying the same single color for a second desired amount of time; and an switch for activating and deactivating said swing training aid; thereby allowing the user to determine if he focused on the ball until after impacting the ball.

According to a yet further aspect of the present invention there is provided a sports training apparatus teaching eye-hand coordination which includes a separate set of light visible only to an observer.

The present invention thus advantageously provides a rugged, inexpensive, but highly effective swing training aid.

DESCRIPTION OF THE PREFERRED EMBODIMENTS OF THE INVENTION

The present invention comprises a swing training aid which may be a baseball or softball bat or some other device that is used to swing at and strike a ball such as, for example, a tennis racket, golf club, or other types of equipment. However, for ease of reference, the embodiments concerning a baseball bat and a golf club will be primarily referred to in this specification.

Figure 1:
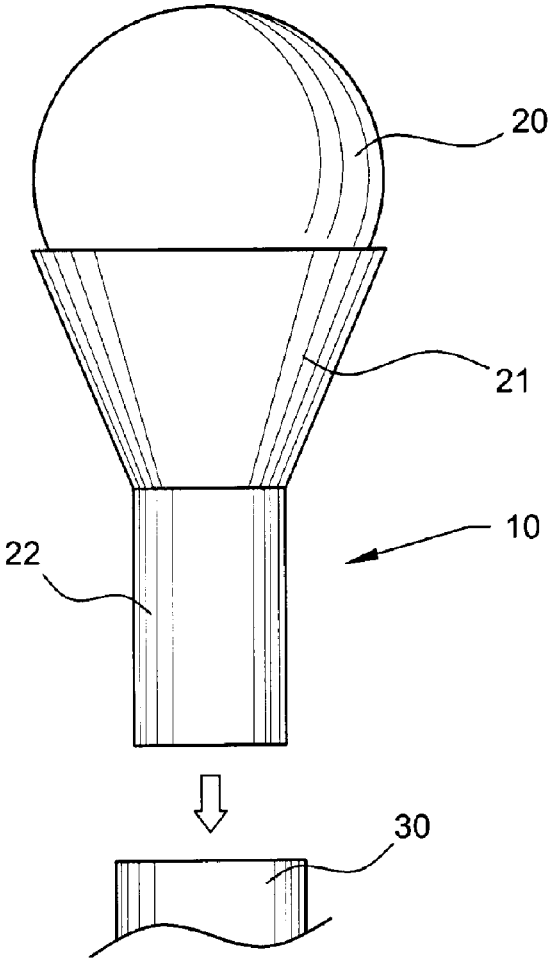
FIG. 1 shows a plan front view of one embodiment of a ball tee insert of the present invention.

Reference will now be made to the drawings, wherein to the extent possible like reference numerals are utilized to designate like components throughout the various views. Referring to FIG. 1, which presence a plan view of preferred embodiment of the present invention comprising a swing training aid 10 which may be inserted into the top of a typical batting tee stanchion 30 said swing training aid 10 having a substantially cylindrical body 22 dimensioned to fit within the upper end of a batting tee stanchion 30 and a ball holder 21 dimensioned to hold the desired ball 20.

Figure 2:
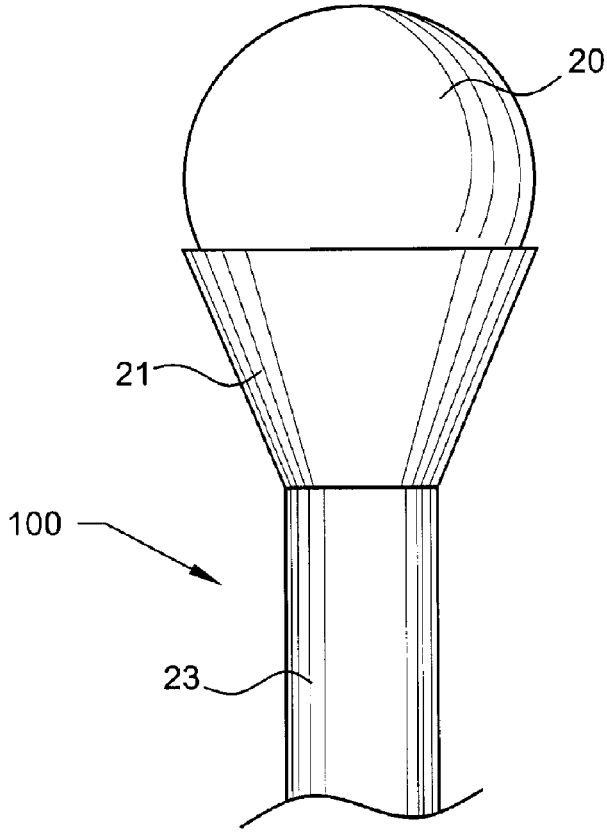
FIG. 2 shows a plan front view of an embodiment of a ball tee stanchion of the present invention.

Referring now to FIG. 2, there is shown a plan view of another preferred embodiment of the present invention comprising a swing training aid 100 having a batting tee stanchion body 23 dimensioned to fit a typical batting tee stanchion base and a ball holder 21 dimensioned to hold a desired ball 20.

Figure 3:
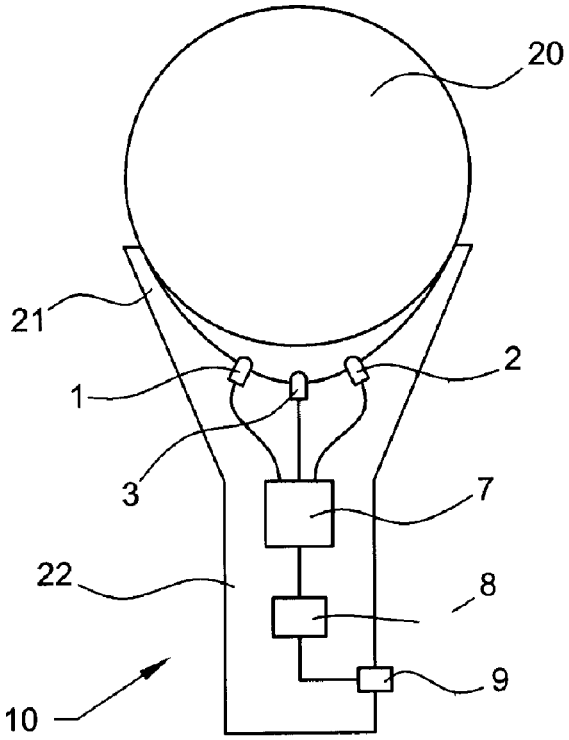
FIG. 3 shows a cross section plan view of one embodiment of the electronics of the present invention.

Referring to FIG. 3, there is shown a plan section view of the present invention of FIG. 1 comprising a swing training aid 10 which may be inserted into the top of a typical batting tee stanchion 30 (FIG. 1) said swing training aid 10 having a ball holder 21 to hold a desired ball 20 and also having a substantially cylindrical body 22 having located therein an infrared emitter 1 positioned to emit an infrared beam at ball 20 at an angle such that the ball deflects the infrared beam to an infrared receiver 2 positioned at an angle such that the infrared beam when deflected off the surface of a ball 20 is detected, a red, blue, green three color light emitting diode LED 3 positioned so the batter can see the emitted color when looking at the ball position on the swing training aid 10. The infrared emitter 1, infrared receiver 2, and the tricolor light emitting diode LED 3 being connected by appropriate connecting wires to microcontroller 7 which is in turn connected to a power supply and battery 8. The power supply and battery 8 is turned off and on by switch 9.

Figure 4:
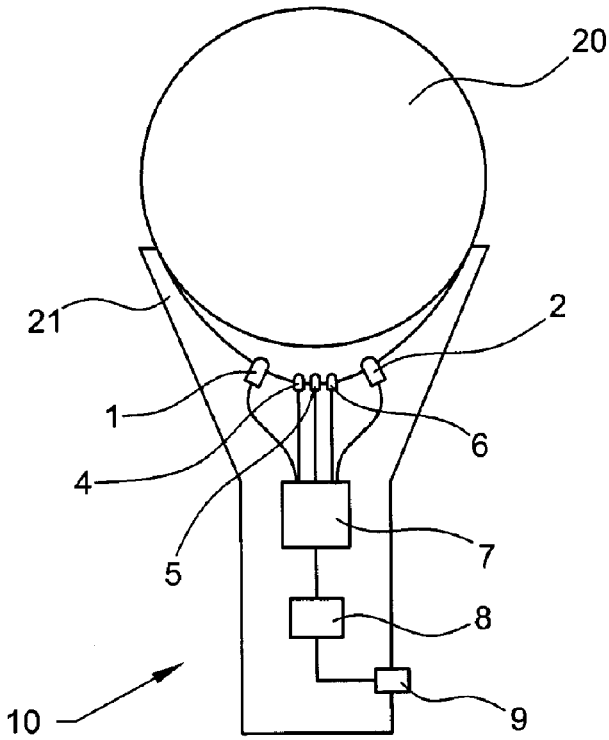
FIG. 4 show a cross section plan view of another embodiment of the electronics of the present invention.

FIG. 4 shows a plan section view of the present invention of FIG. 1 wherein is shown swing training aid 10 having a ball holder 21 to hold a desired ball 20 and also having a substantially cylindrical body 22 having located therein an infrared emitter 1 positioned to emit an infrared beam at ball 20 at an angle such that the ball deflects the infrared beam to an infrared receiver 2 positioned at an angle such that the infrared beam when deflected off the surface of a ball 20 is detected, a red, blue, green light emitting LEDs 4, 5, and 6, positioned so the batter can see the emitted color when looking at the ball position on the swing training aid 10. The infrared emitter 1, infrared receiver 2, and the three colored light emitting LEDs 4, 5, and 6, being connected by appropriate connecting wires to microcontroller 7 which is in turn connected to a power supply and battery 8. The power supply and battery 8 is turned off and on by switch 9.

Figure 5:
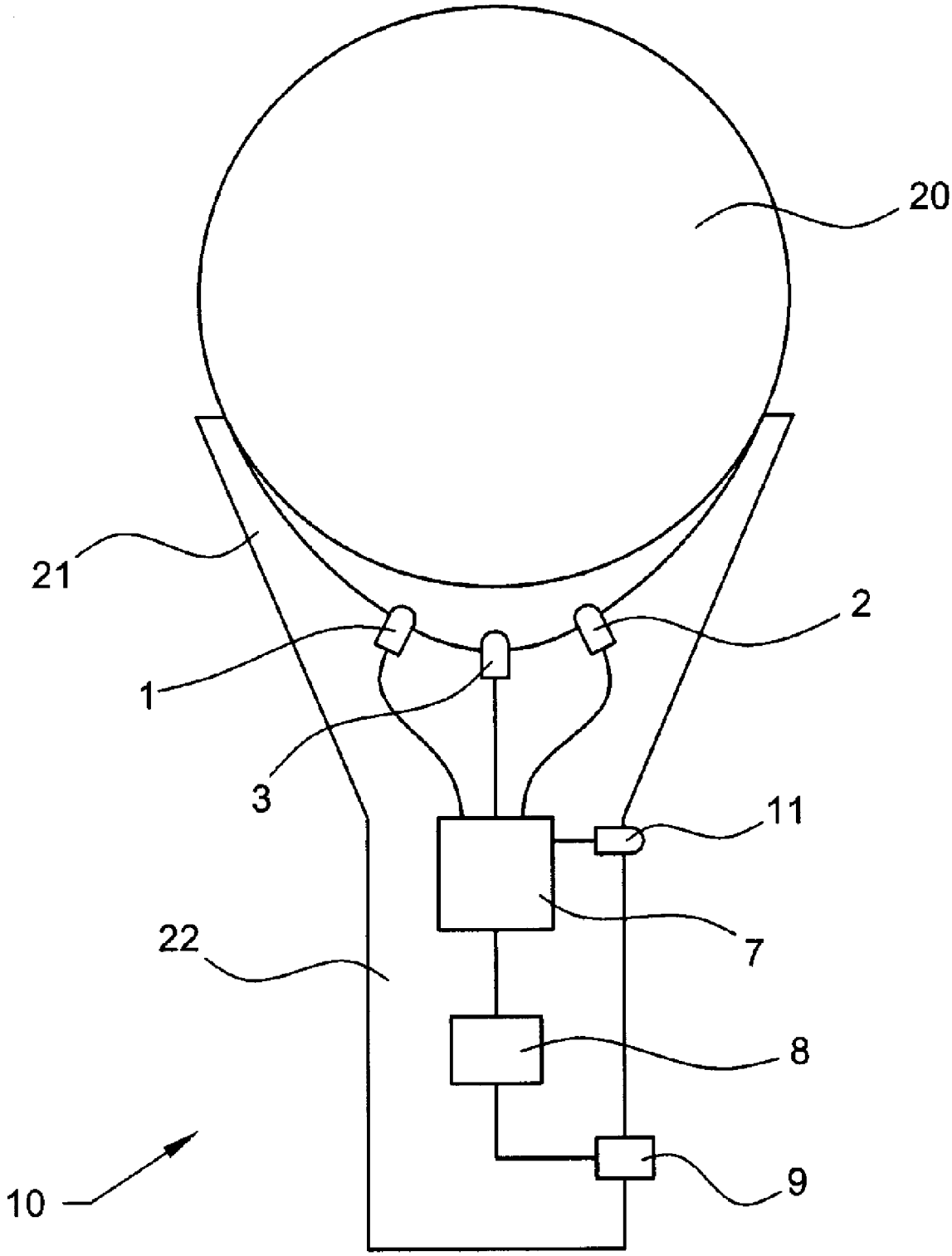
FIG. 5 shows a cross section plan view of yet another embodiment of the electronics of the present invention.

FIG. 5 shows a plan section view of the present invention of FIG. 1 wherein swing training aid 10 having a ball holder 21 to hold a desired ball 20 and also having a substantially cylindrical body 22 having located therein an infrared emitter 1 positioned to emit an infrared beam at ball 20 at an angle such that the ball deflects the infrared beam to an infrared receiver 2 positioned at an angle such that the infrared beam when deflected off the surface of a ball 20 is detected, a red, blue, green tricolor light emitting diode LED 3 positioned so the batter can see the emitted color when looking at the ball position on the swing training aid 10. The infrared emitter 1, infrared receiver 2, and the tricolor light emitting diode LED 3 being connected by appropriate connecting wires to microcontroller 7 which is in turn connected to a power supply and battery 8. The power supply and battery 8 is turned off and on by switch 9. Additionally, there is shown a tricolor LED 11 positioned to be visible to an observer but not to the batter to display the same color as the tricolor LED 3 visible to the batter.

Figures 6, 7:
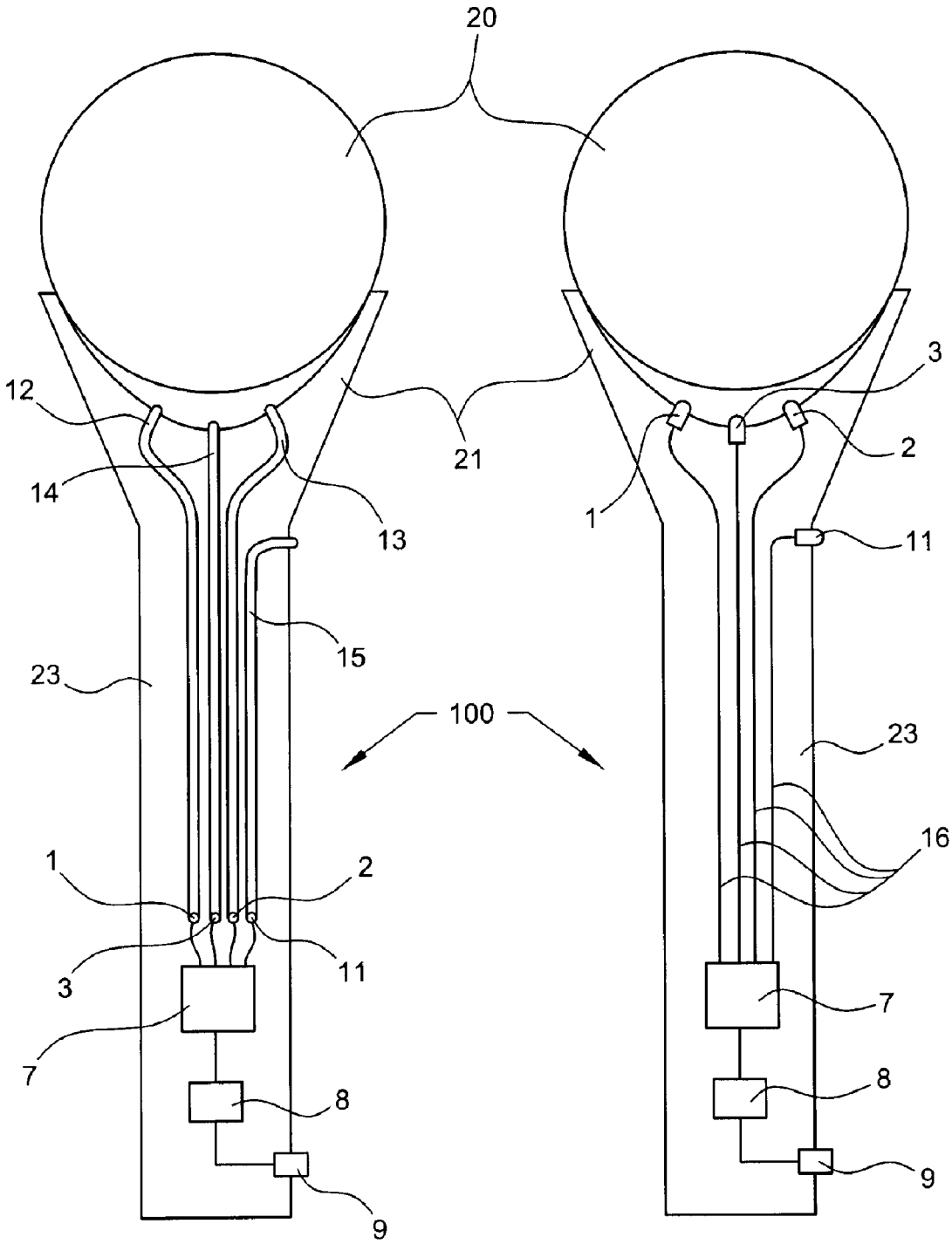
FIG. 6 shows a cross section plan view of an embodiment of the electronics of the present invention where the electronics are removed from the area of impact by a ball-striking implement.
FIG. 7 shows a cross section plan view of another embodiment of moving the electronics from the area of impact by a ball-striking implement.

Turning now to FIG. 6, there is shown a plan section view of the present invention of FIG. 2 wherein swing training aid 100 having a ball holder 21 to hold a desired ball 20 and also having a substantially cylindrical batting tee stanchion body 23 having located at the portion of the stanchion body 23 most removed from ball holder 21 an infrared emitter 1 positioned to emit an infrared beam into one end of a light pipe 12 the other end of said light pipe 12 directing the emitted infrared beam at ball 20 at an angle such that the ball 20 deflects the infrared beam to one end an infrared receiver light pipe 13 the other end of which is positioned to emit the received infrared beam to a infrared receiver 2, a red, blue, green three color light emitting diode LED 3 positioned to emit a colored light into one end of light pipe 14 the other end of which is positioned so the batter can see the emitted color when looking at the ball position on the swing training aid 100. The infrared emitter 1, infrared receiver 2, and the three color light emitting diode LED 3 being connected by appropriate connecting wires to microcontroller 7 which is in turn connected to a power supply and battery 8. The power supply and battery 8 is turned off and on by switch 9. Additionally, there is shown a tricolor LED 11 positioned to emit the same color light as the tricolor LED 3 into one end of light pipe 15 the other end of which is visible to an observer but not to the batter to display the same color as the tricolor LED 3 visible to the batter. This embodiment allows the electronics to all be remote from the area of the swing training aid 100 ball holder 21 area and therefore less prone to damage from shock.

FIG. 7 there is shown a plan section view of the present invention of FIG. 2 wherein swing training aid 100 having a ball holder 21 to hold a desired ball 20 and also having a substantially cylindrical batting tee stanchion body 23 having located therein an infrared emitter 1 positioned to emit an infrared beam at ball 20 at an angle such that the ball deflects the infrared beam to an infrared receiver 2 positioned at an angle such that the infrared beam when deflected off the surface of a ball 20 is detected, a red, blue, green three color light emitting diode LED 3 positioned so the batter can see the emitted color when looking at the ball position on the swing training aid 100. The infrared emitter 1, infrared receiver 2, and the three color light emitting diode LED 3 being connected by appropriate connecting wires 16 to microcontroller 7 which is in turn connected to a power supply and battery 8. The power supply and battery 8 is turned off and on by switch 9. Additionally, there is shown a tricolor LED 11 positioned to be visible to an observer but not to the batter to display the same color as the tricolor LED 3 visible to the batter. The microcontroller 7, power supply and battery 8 and switch 9 being located at the portion of the stanchion body 23 most removed from ball holder 21. This embodiment allows for the microcontroller 7, power supply and battery 8 and switch 9 to be protected from shock associated with a bat hitting the ball holder 21 or the upper portion of stanchion 23.

Figure 8:
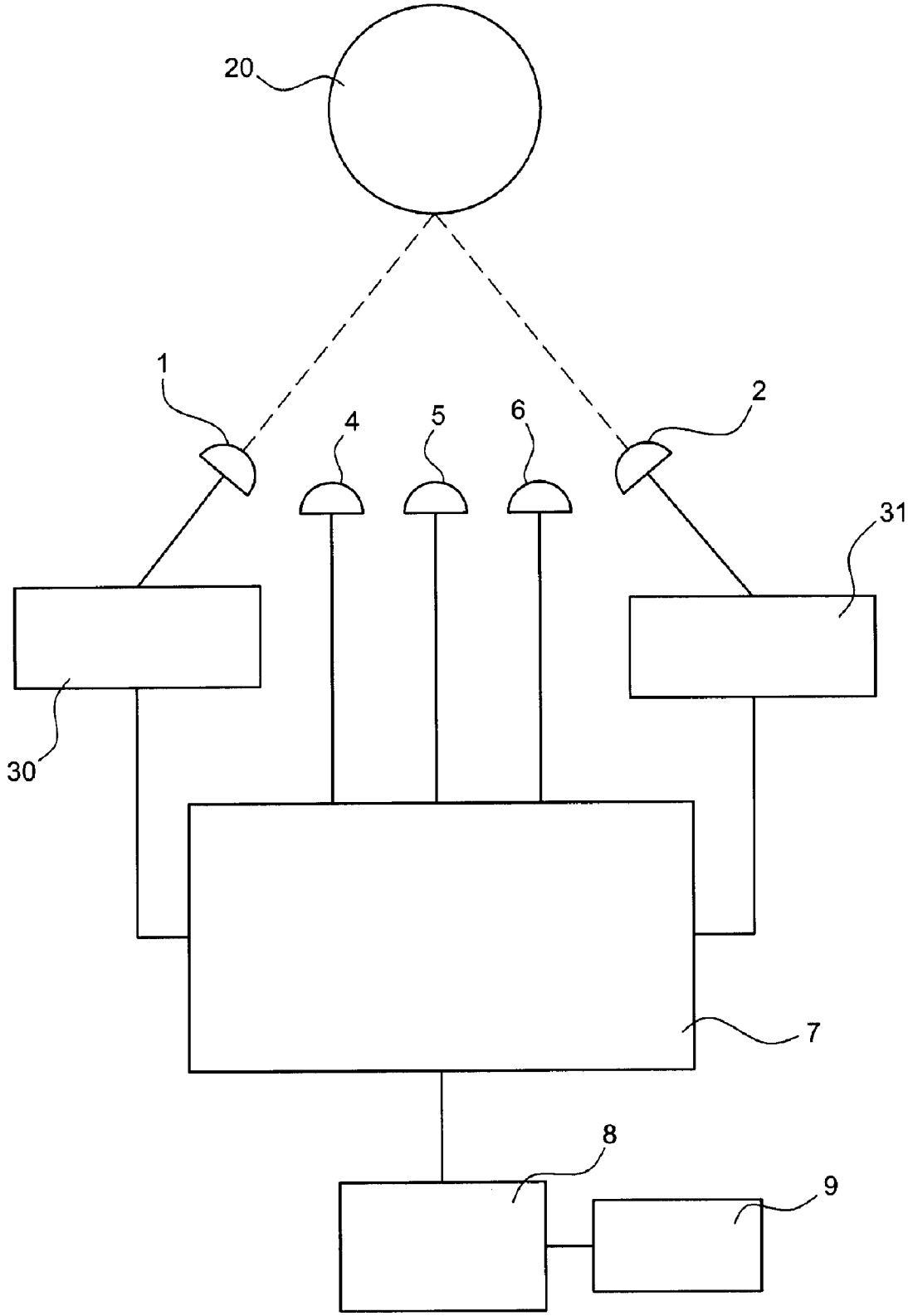
FIG. 8 shows schematic of an embodiment of the present invention using infrared to detect the presence of a ball on the tee.

Turning now to FIG. 8 there is shown a schematic of a preferred embodiment of the present invention comprising a ball 20 having aimed at said ball 20 surface an infrared LED emitter 1 emitting an infrared beam which when deflected off the surface of ball 20 is received by infrared LED receiver 2. The infrared LED emitter 1 is connected to IR Emitter driver circuit 30 which in turn is connected to microcontroller 7 all by appropriate wiring. Likewise, infrared LED receiver 2 is connected to IR receiver buffer circuit 31 which is in turn connected to microcontroller 7 again by appropriate wiring. The microcontroller 7 is connected by appropriate wiring to power supply and battery 8. Also connected by appropriate wiring to power supply and battery 8 is power switch 9. The red 4, blue 5, and green 6 light emitting LEDs are positioned so they are visible to the batter once the ball has been hit from the ball holder (not shown), if the batter does not raise his head before striking the ball, and are connected by appropriate wiring to microcontroller 7. The power switch 9 is not required for the present invention but is an option which provides for prolonged battery life. When the power switch 9 is not in use the microprocessor relies on the microprocessor sleep mode to conserve battery power.

Figure 9:
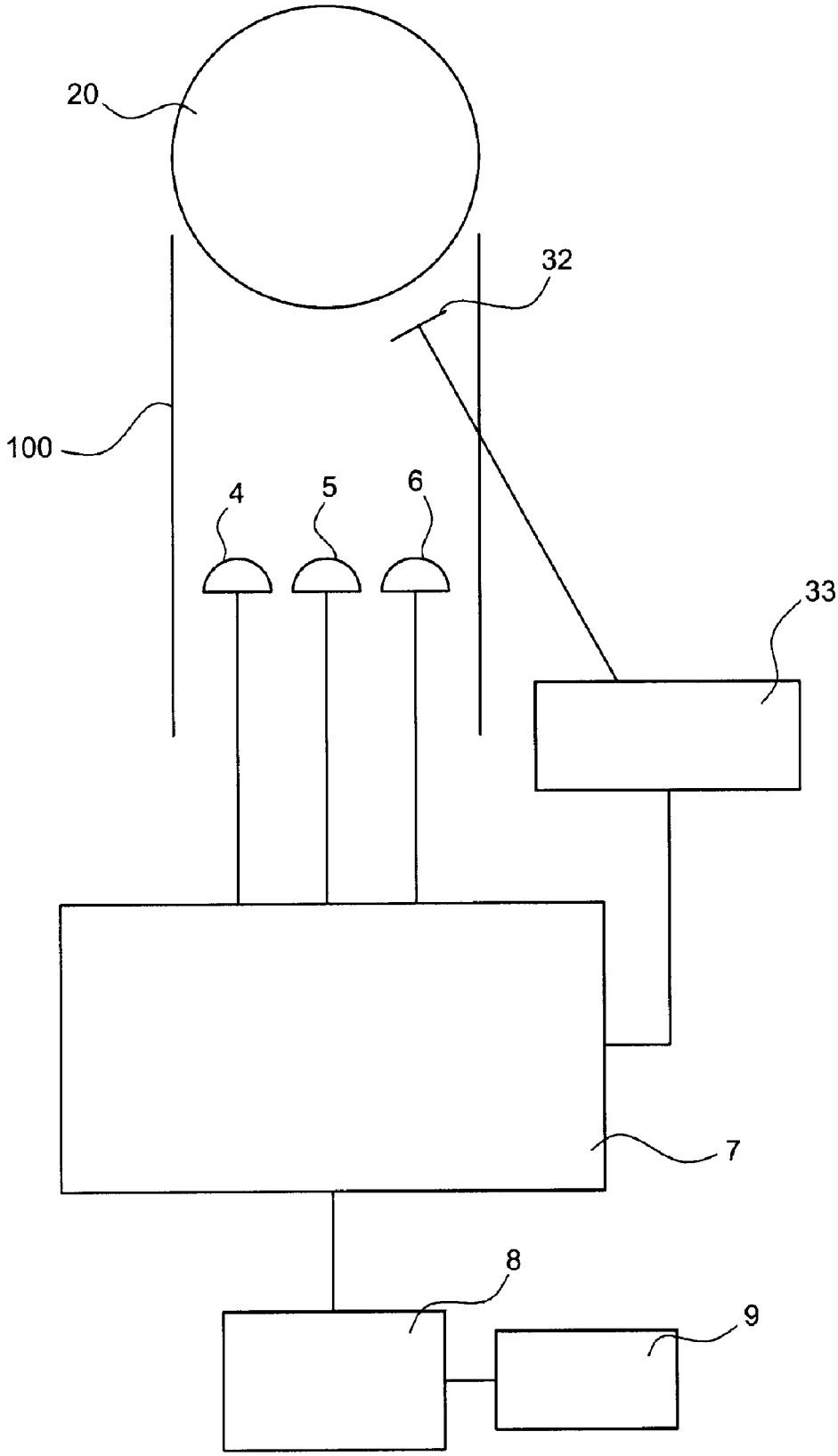
FIG. 9 shows a schematic of an embodiment of the present invention using ambient light to detect the presence of a ball on the tee.

FIG. 9 shows a schematic of a preferred embodiment of the present invention comprising having aimed at a ball 20 sitting on batting tee 100, a surface photo detector sensor 32 connected to photo detector sensor buffer circuit 33 which in turn is connected to microcontroller 7, all by appropriate wiring. This allows the photo detector to detect the presence of ambient light meaning no ball 20 is mounted on the swing training device or to fail to detect the presence of ambient light meaning a ball 20 is mounted on the swing training device. The microcontroller 7 is connected by appropriate wiring to power supply and battery 8. Also connected by appropriate wiring to power supply and battery 8 is power switch 9. The red 4, blue 5, and green 6 light emitting LEDs are positioned so they are visible to the batter once the ball has been hit from the ball holder (not shown), if the batter does not raise his head before striking the ball, and are connected by appropriate wiring to microcontroller 7. The power switch 9 is not required for the present invention but is an option which provides for prolonged battery life by allowing the unit to be turned off when not in use. When the power switch 9 is not in use the microprocessor relies on the microprocessor sleep mode to conserve battery power.

Figure 10:
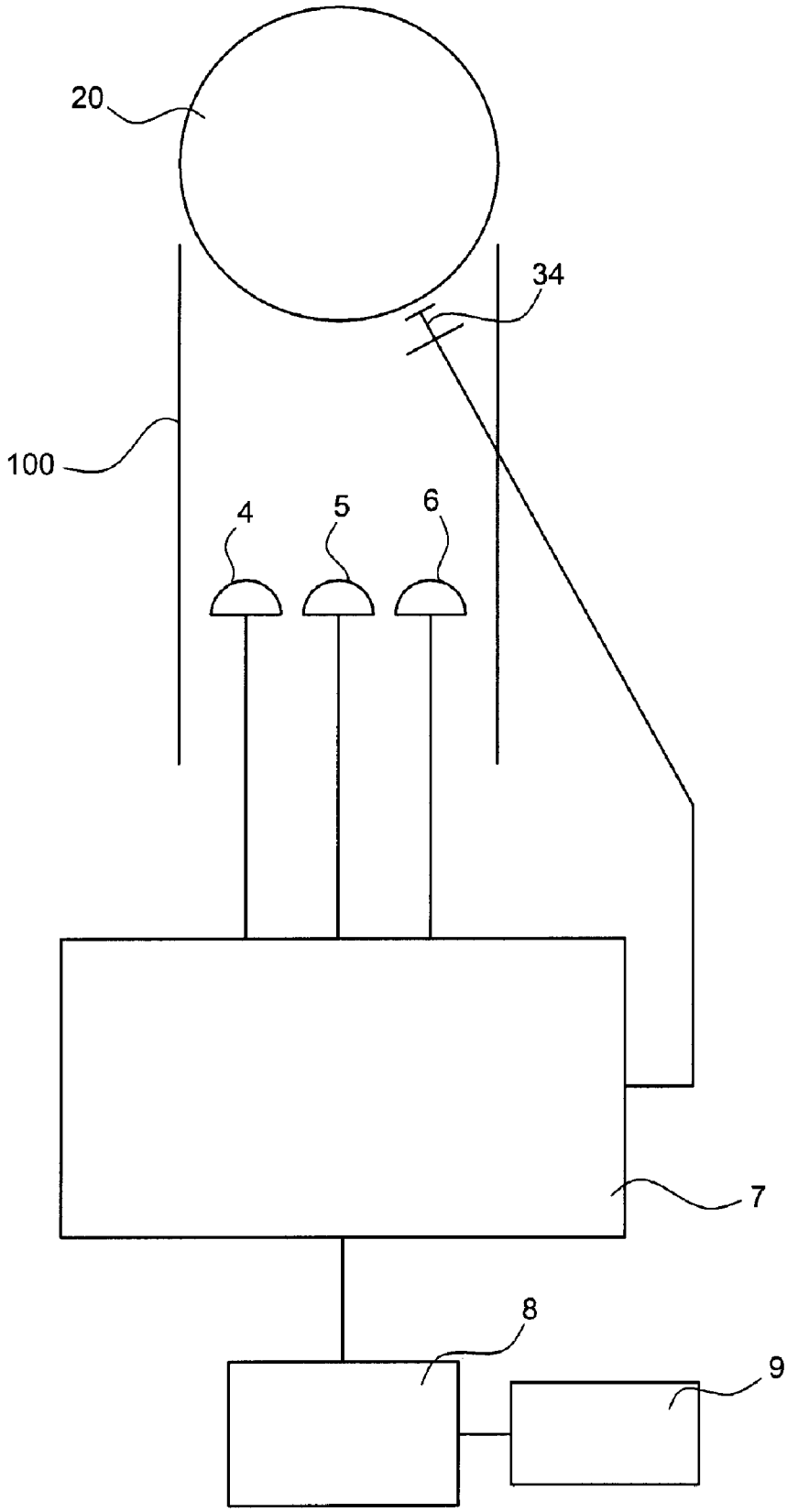
FIG. 10 shows a schematic of an embodiment of the present invention using a electrical switch to detect the presence of a ball on the tee.

FIG. 10 shows a schematic of another preferred embodiment of the present invention comprising mechanical electrical switch 34 positioned to be depressed or otherwise activated by the weight of a ball 20 mounted on the swing training device batting tee 100. The switch 34 is connected by appropriate wiring to microcontroller 7 which in turn is connected by appropriate wiring to power supply and battery 8. Also connected by appropriate wiring to power supply and battery 8 is power switch 9. The red 4, blue 5, and green 6 light emitting LEDs are positioned so they are visible to the batter once the ball has been hit from the ball holder (not shown), if the batter does not raise his head before striking the ball, and are connected by appropriate wiring to microcontroller 7. The power switch 9 is not required for the present invention but is an option which provides for prolonged battery life by allowing the unit to be turned off when not in use. When the power switch 9 is not in use the microprocessor relies on the microprocessor sleep mode to conserve battery power.

Figure 11:
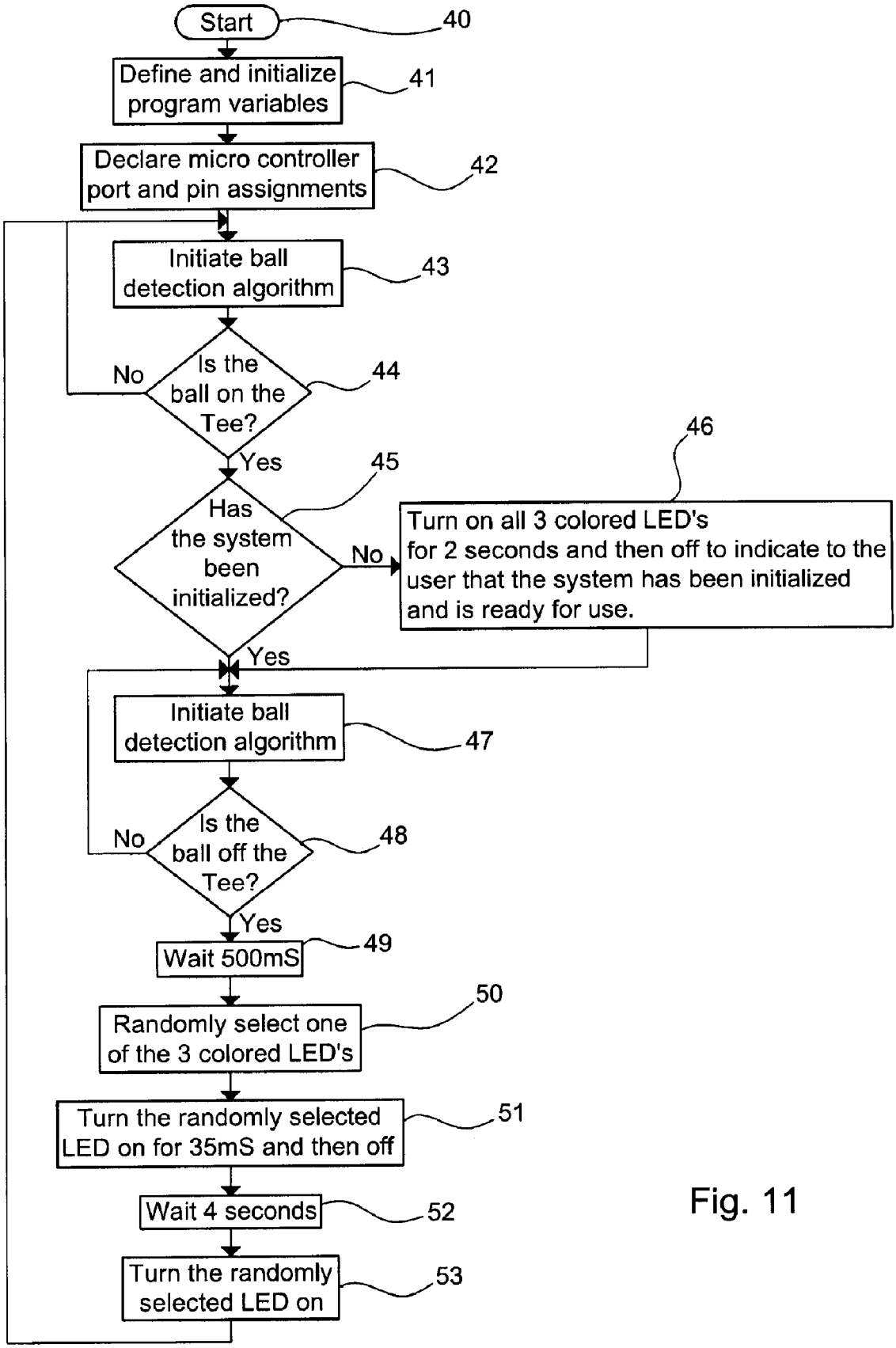
FIG. 11 shows a schematic of the algorithm used by the micro controller of the present invention.

FIG. 11 shows a block diagram of the microcontroller procedure used by the present invention to randomly active a single color of tricolor LED 3 or one of the LEDs 4, 5, and 6 comprising the steps of starting the procedure 40; defining and initializing the program variables 41; declare the microcontroller port and pin assignments 42; initiate the ball detection algorithm 43; determine if the ball is on the tee 44; if no return to step 43, if yes, go to step 45; determine if the system has been initialized 45; if no, turn all three colored LED's on for two seconds and then off to indicate to the user that the system has been initialized and is ready for use 46; if yes proceed to initiate the ball detection algorithm 47; determine if the ball is on the tee 48; if no, return to step 47; if yes, wait 500 milliseconds 49 and then randomly select one of the 3 colored LEDs 50; turn the randomly selected LED on for 35 milliseconds and then turn off 51; wait four seconds 52; turn the randomly selected LED on 53; ending one cycle of the program.

Figure 12:
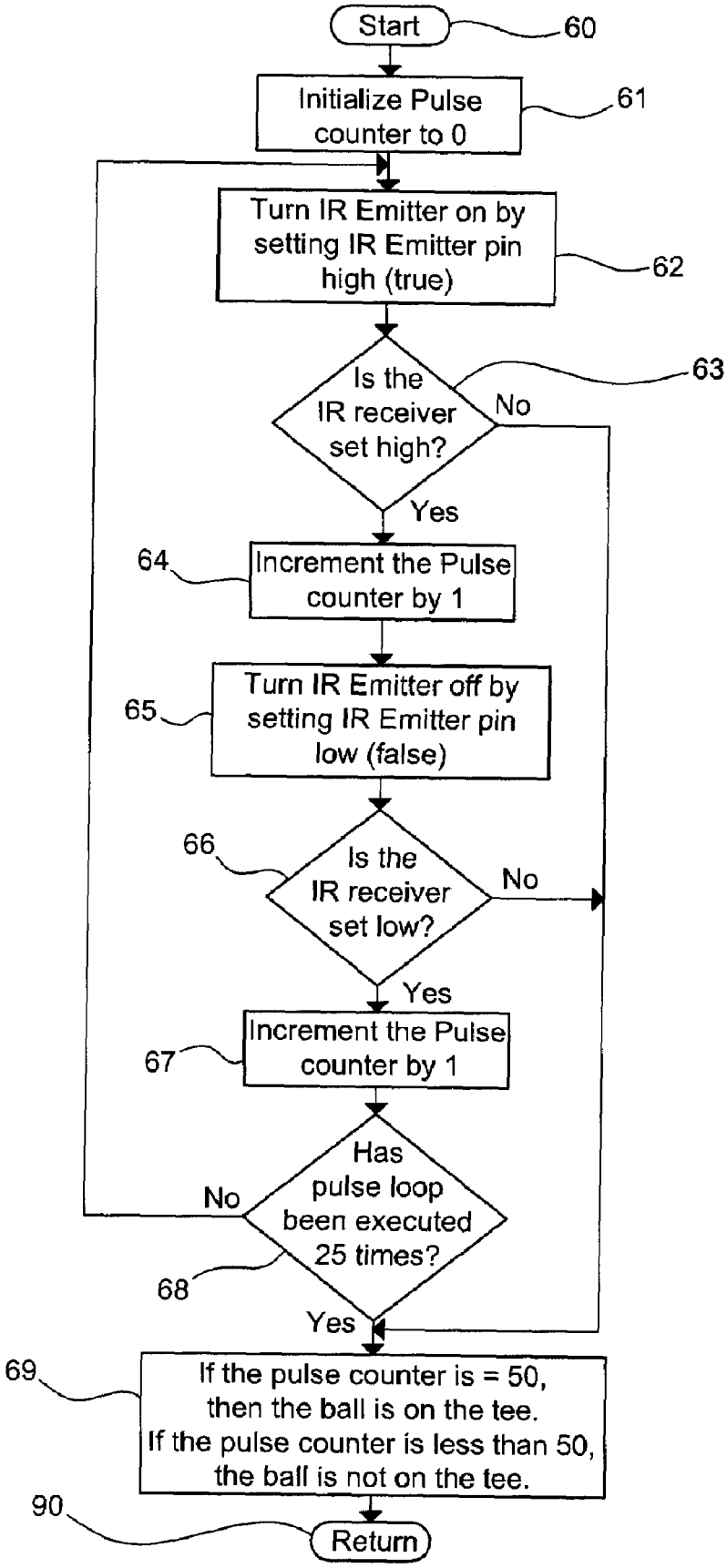
FIG. 12 shows a schematic of the infrared ball detection algorithm of the present invention.

FIG. 12 shows a block diagram of the infrared ball detection algorithm of the present invention comprising the steps of starting the algorithm 60; initializing the pulse counter to zero 61; turn on the IR Emitter on by setting the IR Emitter pin high (true) 62, determine if the IR receiver is set high 63; if no proceed to step 69, if yes increment the pulse counter by one 64; turn the IR Emitter off by setting the IR Emitter pin low (false) 65; determine if the IR receiver is set low (false) 66; if no proceed to step 69, if yes increment the Pulse counter by one 67; determine if the pulse loop has been executed 25 times 68; if no go to step 62, if yes go to step 69; determine if a ball is on the tee 69; if the pulse counter is equal to 50 then a ball is on the tee and if the pulse counter is less than 50 then there is no ball on the tee; return 90. The ball detection routine reduces the likelihood of a false detection of the ball.

Figure 13:
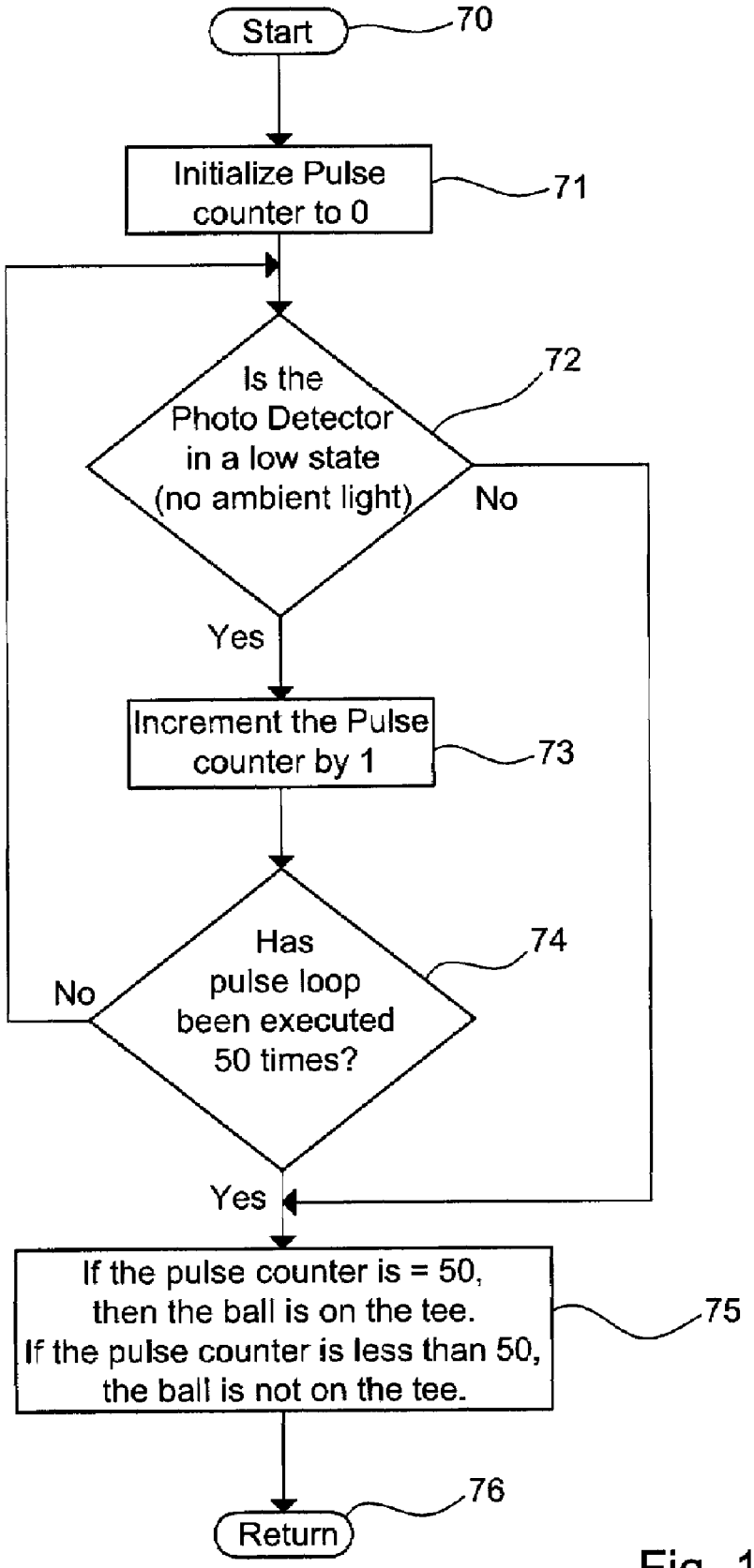
FIG. 13 shows a schematic of the ambient light photo detector ball detection algorithm of the present invention.

FIG. 13 shows a block diagram of the photo detector ball detection algorithm of the present invention comprising the steps of starting the algorithm 70; initializing the pulse counter to zero 71; determining if the photo detector is in a low state (no ambient light) 72; if no proceed to step 75, if yes increment the pulse counter by one 73; determine if the pulse loop has been executed fifty times 74; if no proceed to step 72, if yes go to step 75; determine if the pulse counter count equals 50 which means a ball is on the tee, or if the pulse counter is less than fifty then there is no ball on the tee; return to beginning 76. The ball detection routine reduces the likelihood of a false detection of the ball.

Figure 14:
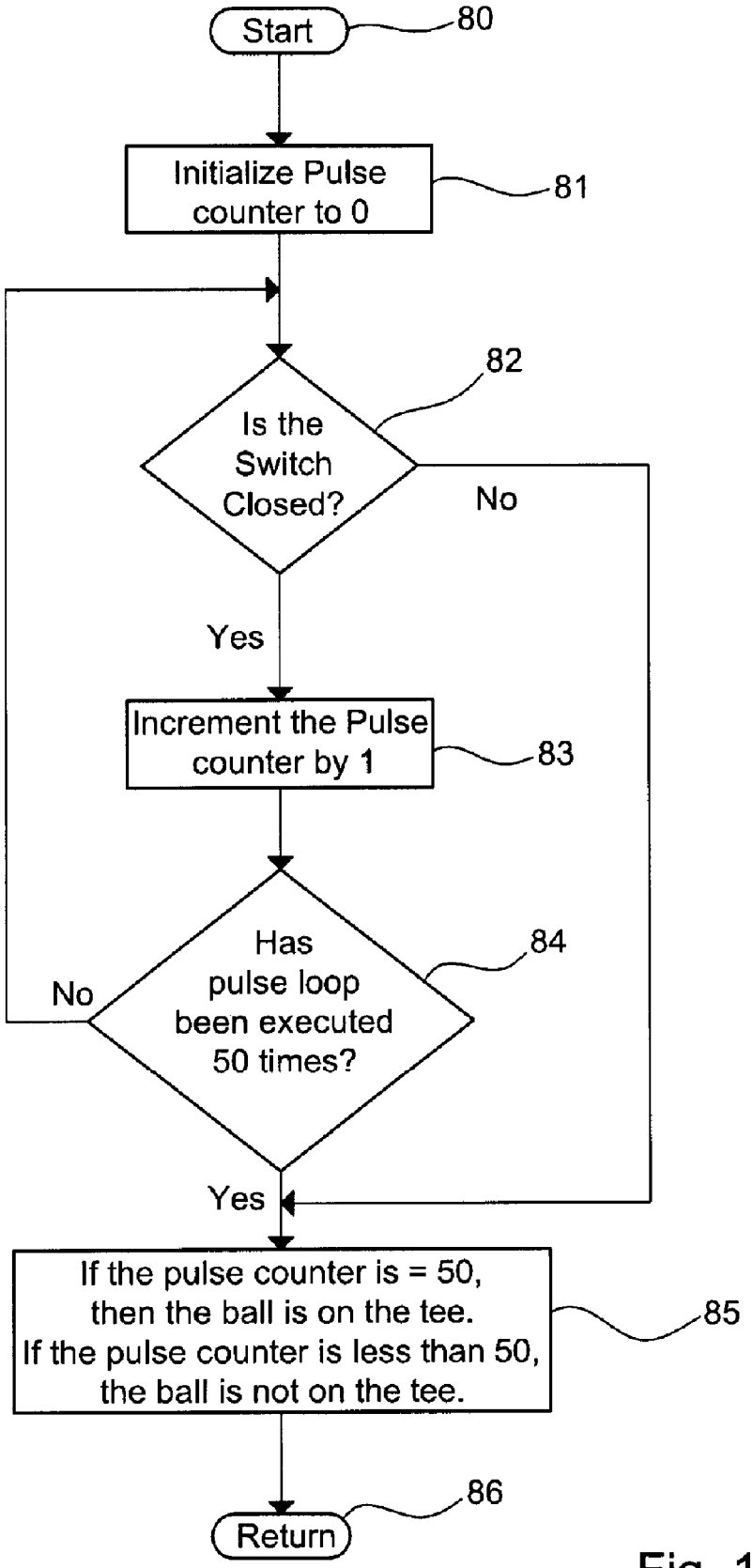
FIG. 14 shows a schematic of the electrical switch ball detection algorithm of the present invention.

FIG. 14 shows a block diagram of the mechanical electrical switch ball detection algorithm of the present invention comprising the steps of starting the algorithm 80; initializing the pulse counter to zero 81; determining if the switch is closed 82; if no proceed to step 85, if yes increment the pulse counter by one 83; determine if the pulse loop has been executed fifty times 84; if no return to step 82, if yes proceed to step to 85; determine if the pulse counter is equal to fifty then the ball is on the tee, if the pulse counter is less than fifty then the ball is not on the tee 85; return to beginning 86. The ball detection routine reduces the likelihood of a false detection of a ball.

Figure 15:
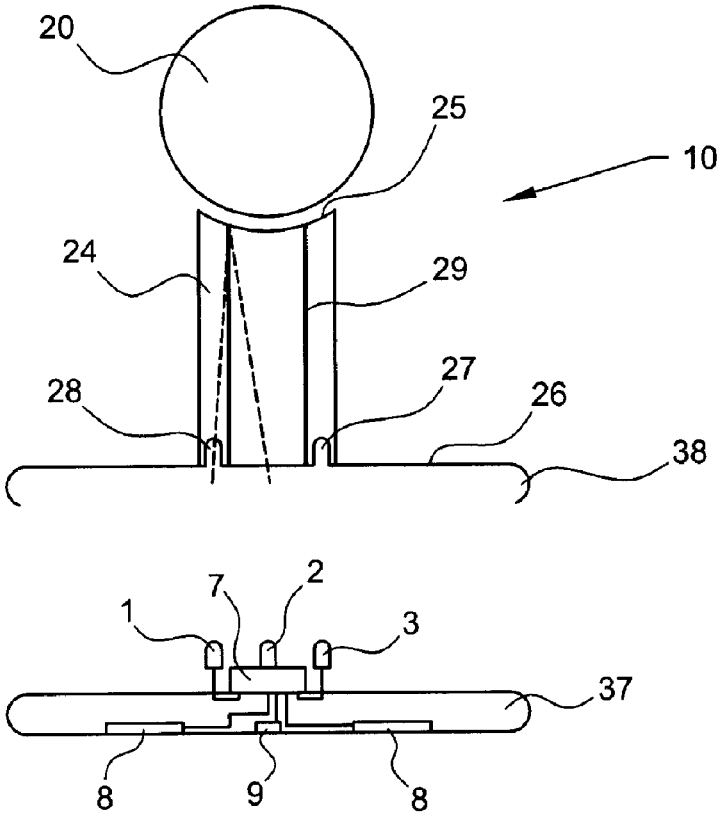
FIG. 15 shows a cross section plan view of a preferred embodiment of a golf ball tee of the present invention.

FIG. 15 shows a plan section view of the present invention comprising a swing training aid 10 configured to act as a golf ball tee and mountable on a base 37 said swing training aid 10 having a substantially cylindrical translucent light pipe body 24 having a first end 25 adapted to hold a golf ball and a second end 26 adapted for cooperative attachment through lip 38 to said mountable base 37. Substantially cylindrical translucent light pipe body 24 further having located in said second end 26 a first cavity 27 for receiving a tricolor LED 3 permanently mounted on said mountable base 37 as well as second cavity 28 for receiving an infrared emitter 1 also permanently mounted on said mountable base 37. Said substantially cylindrical translucent light pipe body 24 further having a surface lining 29 on the inside of the cylinder wall that is substantially opaque on lining 29 exterior side and reflective on its interior side. Mountable base 37 has located thereon an infrared emitter 1 positioned to mount within second cavity 28 and emit an infrared beam at ball 20 at an angle such that the ball deflects the infrared beam to an infrared receiver 2 positioned at an angle such that the infrared beam when deflected off the surface of a ball 20 is detected by an infrared detector 2, a red, blue, green three color light emitting diode LED 3 positioned to mount within first cavity 27 when body 24 is mounted onto mountable base 37 so the golfer can see the emitted color when looking at the ball position on the swing training aid 10. The infrared emitter 1, infrared receiver 2, and the tricolor light emitting diode LED 3 being connected by appropriate connecting wires to microcontroller 7 which is in turn connected to a power supply and battery 8. The power supply and battery 8 is turned off and on by switch 9.

Figure 16:
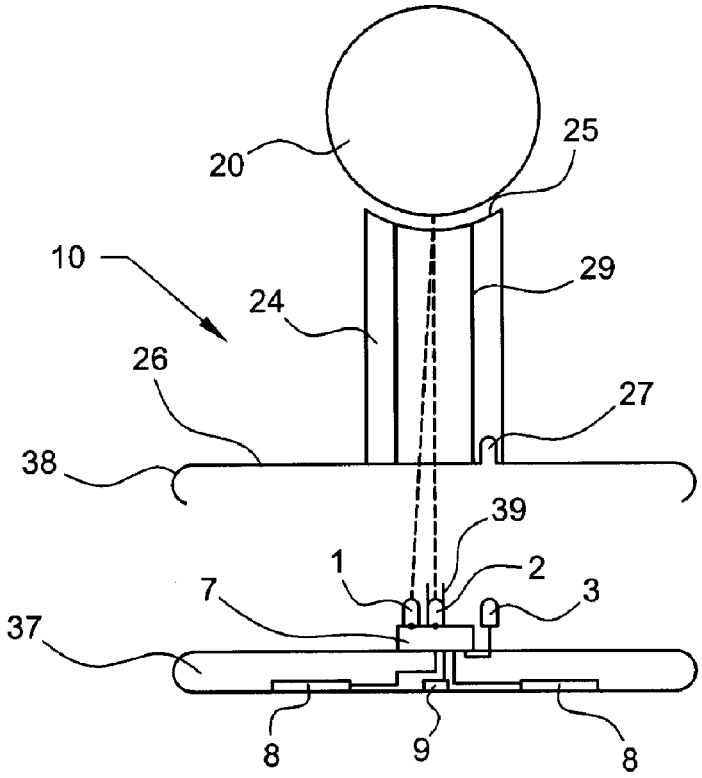
FIG. 16 shows a cross section plan view of another preferred embodiment of a golf ball tee of the present invention.

Finally, FIG. 16 shows a plan section view of the present invention comprising a swing training aid 10 configured to act as a golf ball tee and mountable on a base 37 said swing training aid 10 having a substantially cylindrical translucent light pipe body 24 having a first end 25 adapted to hold a golf ball and a second end 26 adapted for cooperative attachment through lip 38 to said mountable base 37. Substantially cylindrical translucent light pipe body 24 further having located in said second end 26 a first cavity 27 for receiving a tricolor LED permanently mounted on said mountable base 37. Said substantially cylindrical translucent light pipe body 24 further having a surface lining 29 on the inside of the cylinder wall that is substantially opaque on lining 29 exterior side and reflective on its interior side. Mountable base 37 has located thereon an infrared emitter 1 positioned to emit an infrared beam at ball 20 at an angle such that the ball deflects the infrared beam to an infrared receiver 2 positioned at an angle such that the infrared beam when deflected off the surface of a ball 20 is detected by an infrared detector 2. Infrared detector 2 further having an opaque blinder 38 mounted thereover to prevent infrared light other than that reflected by the golf ball from being detected. A red, blue, green three color light emitting diode LED 3 positioned so the batter can see the emitted color when looking at the ball position on the swing training aid 10 is also permanently mounted on mountable base 37. The infrared emitter 1, infrared receiver 2, and the tricolor light emitting diode LED 3 being connected by appropriate connecting wires to microcontroller 7 which is in turn connected to a power supply and battery 8. The power supply and battery 8 is turned off and on by switch 9.

In practice, for use in baseball or softball, the batter or an observer activates the swing training aid and places an appropriate ball on the ball holder and once the electronics are initialized the batter swings at the ball. When the electronics determine the ball is no longer on the tee a single colored LED is randomly activated for 35 milliseconds. After the 35 milliseconds the LED is turned off for four seconds and then turned back on. If the batter has maintained eye contact with the ball through the swing he will see the color of the lit LED during its 35 microsecond on period. If he has not kept his focus on the ball, through the hitting of the ball, he will not see the light and will not be able to determine which color LED was on. The second lighting of the LED after about four seconds allows the batter and/or observer to confirm the batter did indeed see the light during the swing. In this way the batter is forced to watch the ball during the swing including the moment it is struck by the bat.

In practice, for use in golf, the golfer activates the swing training aid and places a golf ball on the ball 20 on golf ball receiving end 25 of the swing training aid 10 and once the electronics are initialized the golfer swings at the golf ball. When the electronics determine the golf ball is no longer on the tee a single color of the three color LED is randomly activated for about 35 milliseconds. After the about 35 milliseconds the LED is turned off for about four seconds and then turned back on. If the golfer has maintained eye contact with the ball through the swing he will see the color of the lit LED during its 35 microsecond on period. If he has not kept his focus on the ball through the hitting of the ball he will not see the light and will not be able to determine which color of the LED was on. The second lighting of the LED after about four seconds allows the golfer and/or an observer to confirm the golfer did indeed see the light during the swing. In this way the golfer is forced to watch the ball during the swing including the moment it is struck by the golf club.

The present invention may be constructed of plastics commonly used to produce batting tees and the like. Such plastics include for example, polypropylene, butylenes and the like, as well as plastics used for such items as super balls which provide a dense, shock absorbing medium to protect the internal components of the present invention from damage due to shock caused by the bat missing the ball and hitting the tee.

Although the preferred embodiments of the present invention has been disclosed, various changes and modifications may be made without departing from the scope of the invention as set forth in the appended claims.

What is claimed is:

1. A sports training apparatus teaching eye-hand coordination for impacting an object comprising:

a swing training aid comprising, in cooperative combination;

a substantially cylindrical body having a ball holder positioned on one end of said substantially cylindrical body;

a ball detecting apparatus in said swing training aid operable in a configuration for determining the presence or absence of a ball on said ball holder, and three colored indicator lights operable in a configuration to display a single color for a desired amount of time after the ball is impacted off of said ball holder, then turning off said single color indicator light for a desired amount of time and finally displaying the same single color indicator light for a second desired amount of time;

thereby allowing the user to determine if he focused on the ball until after impacting the ball.

2. The swing training aid as claimed in claim 1 wherein, said swing training aid is dimensioned to fit in the top of a batting tee stanchion.

3. The swing training aid as claimed in claim 1 wherein, said swing training aid is dimensioned to be a batting tee stanchion.

4. The swing training aid as claimed in claim 1 wherein, said ball detecting apparatus comprises an infrared emitter and corresponding infrared detector.

5. The swing training aid as claimed in claim 1 wherein, said ball detecting apparatus comprises an ambient light photo detector.

6. The swing training aid as claimed in claim 1 wherein, said ball detecting apparatus comprises a mechanical electrical switch.

7. The swing training aid as claimed in claim 1 wherein, said three colored indicator lights are three separate single color light emitting diodes (LED).

8. The swing training aid as claimed in claim 1 wherein, said three colored indicator lights are a single tricolor light emitting diode (LED) capable of emitting three separate colors of light.

9. The swing training aid as claimed in claim 1 wherein, said swing training aid includes a second three colored indicator lights visible only to an observer.

10. A sports training apparatus teaching eye-hand coordination for impacting an object comprising:

a swing training aid comprising, in cooperative combination;

a substantially cylindrical body having a ball holder positioned on one end of said substantially cylindrical body;

a ball detecting apparatus in said swing training aid operable in a configuration for determining the presence or absence of a ball on said ball holder, three colored indicator lights operable in a configuration to display a single color for a desired amount of time after the ball is impacted off of said ball holder, then turning off said single color indicator light for a desired amount of time and finally displaying the same single color indicator light for a second desired amount of time; and a switch for activating and deactivating said swing training aid;

thereby allowing the user to determine if he focused on the ball until after impacting the ball.

11. The swing training aid as claimed in claim 10 wherein, said swing training aid is dimensioned to fit in the top of a batting tee stanchion.

12. The swing training aid as claimed in claim 10 wherein, said swing training aid is dimensioned to be a batting tee stanchion.

13. The swing training aid as claimed in claim 10 wherein, said ball detecting apparatus comprises an infrared emitter and corresponding infrared detector.

14. The swing training aid as claimed in claim 10 wherein, said ball detecting apparatus is selected from the group consisting essentially of an ambient light photo detector and a mechanical electrical switch.

15. The swing training aid as claimed in claim 10 wherein, said three colored indicator lights are three separate single color light emitting diodes (LED).

16. The swing training aid as claimed in claim 10 wherein, said three colored indicator lights are a single tricolor light emitting diode (LED) capable of emitting three separate colors of light.

17. The swing training aid as claimed in claim 10 wherein, said swing training aid includes a second three colored indicator lights visible only to an observer.

18. A sports training apparatus teaching eye-hand coordination for impacting an object comprising:

a swing training aid comprising, in cooperative combination;

a substantially cylindrical body having a first end adapted to hold a ball and a second end adapted to mount on a base;

a base having permanently mounted thereon a ball detecting apparatus having a configuration for determining the presence or absence of a ball on said ball holder;

three colored indicator lights permanently mounted to said base and operable in a configuration to display a single color for a desired amount of time after the ball is impacted off of said ball holder, then turning off said single color indicator light for a desired amount of time and finally displaying the same single color indicator light for a second desired amount of time; and a switch for activating and deactivating said swing training aid;

thereby allowing the user to determine if he focused on the ball until after impacting the ball.

19. The swing training aid as claimed in claim 18 wherein, said substantially cylindrical body is substantially translucent and the inside of said cylindrical body has a lining which is opaque to light its outside facing surface and reflective to light on its inside facing surface.

20. The swing training aid as claimed in claim 18 wherein, said infrared detector has a blinder mounted thereon allow detection of only infrared light reflected off of a ball mounted on said swing training aid.

* * * * *